United States Patent [19]

Young

[11] 4,032,907

[45] June 28, 1977

[54] REMOTE ALARM MONITORING AND CIRCUIT CONTROL SYSTEM

[75] Inventor: Danny J. Young, Tyler, Tex.

[73] Assignee: James W. Fair, Tyler, Tex. ; a part interest

[22] Filed: Aug. 8, 1975

[21] Appl. No.: 603,013

[52] U.S. Cl. ..... 340/213 R; 340/324 R; 340/409; 340/416; 179/5 R

[51] Int. Cl.[2] ..... G08B 19/00

[58] Field of Search ..... 179/5 R; 340/213 R, 340/213.2, 213 Q, 226, 216, 324 R, 409, 412, 415, 416, 420

[56] References Cited

UNITED STATES PATENTS

| | | | |
|---|---|---|---|
| 3,099,824 | 7/1963 | Vitt et al. | 340/213.2 |
| 3,305,850 | 2/1967 | Suozzo et al. | 340/213.2 |
| 3,437,759 | 4/1969 | McKinzie | 179/5 R |

*Primary Examiner*—Alvin H. Waring
*Attorney, Agent, or Firm*—Cushman, Darby & Cushman

[57] ABSTRACT

A remote alarm monitoring and control circuit control system for centralized monitoring of areas remote from the monitoring location. The system comprises a centrally located monitoring board connected via conventional phone lines to a plurality of remotely located control boxes each in turn being connected to a number of individual sensor inputs. Each of the control boxes is capable of sending two different and distinguishable signals via one telephone line connected to the monitoring board. Further, the system at the remotely located control boxes can be reset from the monitoring board without the need for gaining entry to the location where the remotely located control box is placed.

14 Claims, 2 Drawing Figures

REMOTE ALARM MONITORING AND CIRCUIT CONTROL SYSTEM

Figure 1:
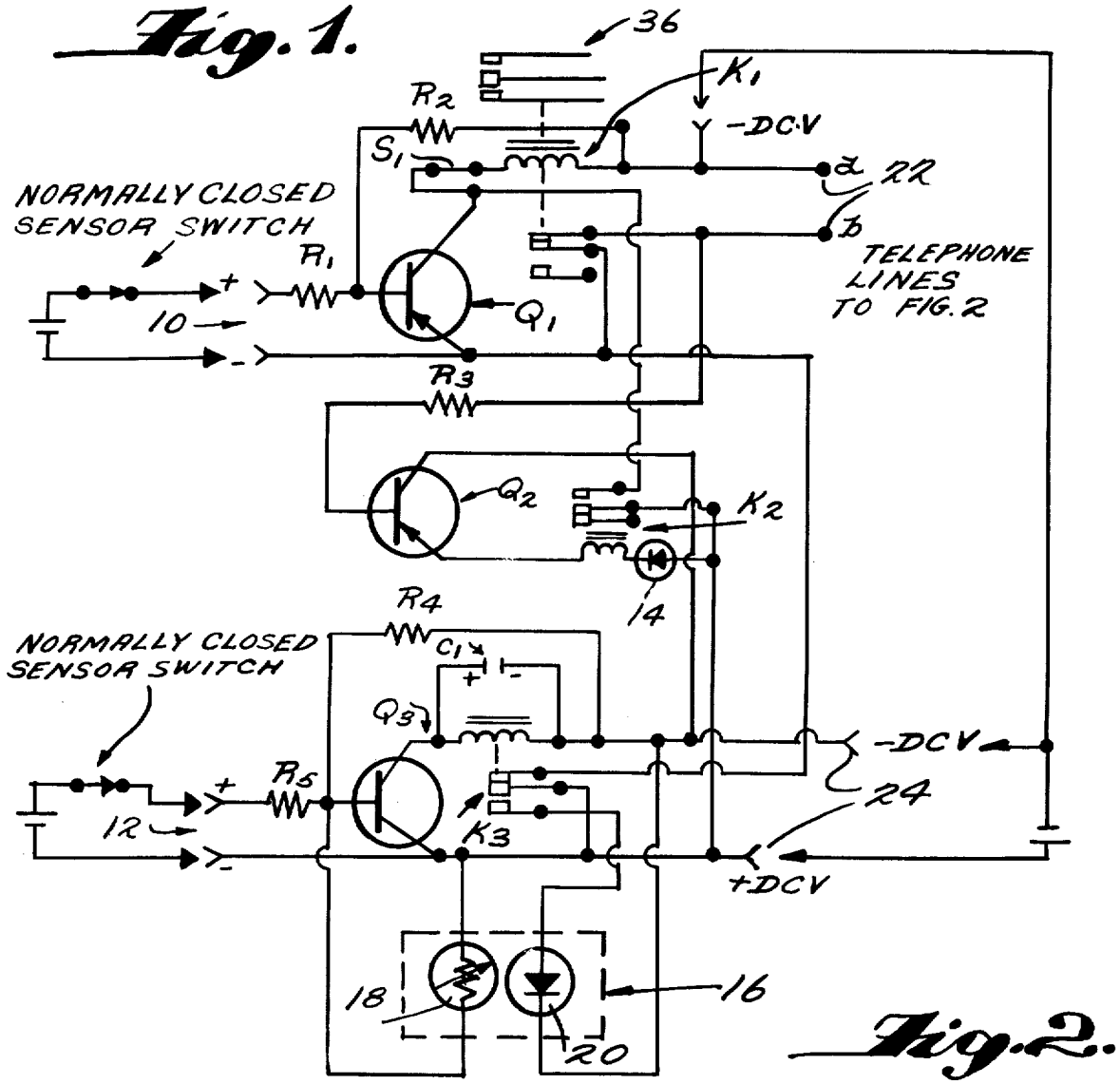

This invention relates to a remote monitoring and control circuit system and apparatus for use in monitoring the security of areas located remotely from a central monitoring station. For instance, this could be the monitoring of houses within a city from a central police station monitoring board or the monitoring of machinery widely scattered about a plant from a central location.

The system can be designed to generate warnings or alarm signals for a variety of events such as the breaking of windows or prying of doors during a burglary or the detection of fire, smoke or some other problem within a building or structure or the operational condition of machinery. Previous attempts have been made to develop systems which can produce signals when an event such as one of the above is sensed but the previous systems known in the art have dealt with the problem through the use of complex circuitry and in most instances, have not been able to readily distinguish between different types of sensed events or conditions.

Further, while some prior art systems have employed the use of conventional phone lines for purposes of conveying information from remote stations to a central monitoring station, such prior art systems have suffered from the disadvantage of not being able to reset the remotely located control stations from the central monitoring station. Should investigation of the alarm prove that the alarm was mistakenly generated, immediate access to the location where the remotely located control stations was placed would be required to be able to reset the control box portion of the system.

Systems heretofore patented include the following: United States Patents:

| | | |
|---|---|---|
| 3,866,194 | Lawton | Feb. 11, 1975 |
| 3,798,628 | Ive | Mar. 19, 1974 |
| 3,707,708 | Dan | Dec. 26, 1972 |
| 3,706,088 | Jorgensen | Dec. 12, 1972 |
| 3,631,432 | Stallbrass | Dec. 28, 1971 |
| 3,626,403 | Ive | Dec. 7, 1971 |
| 3,480,938 | Martin | Nov. 25, 1969 |
| 3,456,251 | Smith et al | July 15, 1969 |
| 3,430,218 | Healey | Feb. 25, 1969 |
| 3,401,234 | Heald | Sep. 10, 1968 |
| 3,388,389 | Henriques | June 11, 1968 |
| 3,334,340 | McConnell | Aug. 1, 1967 |
| 3,254,331 | Ida et al | May 31, 1966 |
| 2,994,073 | Pelovitz | July 25, 1961 |

The two Ive U.S. Pat. Nos. 3,798,628 and 3,626,403 refer to protective systems using two-wire and one-wire loops, respectively. These patents refer to resistive terminated or resistive seeking circuitry with a change in this predetermined resistance causing an alarm condition to exist. As will be more fully explained hereinafter, applicant's system is not sensitive to resistive changes. The basic circuitry of the present invention is voltage current sensitive rather than resistance sesitive. In addition, the Ive patents do not concern the use of common conventional telephone lines nor do they indicate ways in which differentiation between signals can be easily obtained.

Lawton, U.S. Pat. 3,866,194 and Dan U.S. Pat. No. 3,707,708 show the use of a light-emitting diode or an audio alert, respectively, as the indicating means for providing an indication that an alarm condition has been created but likewise do not disclose how to distinguish between signals nor the resetting capability of the present invention.

Several of the other patents referred to above indicate the use of telephone lines, but they do not disclose the use of the monitoring station to remotely control the setting of the premote control stations nor the particular method of distinguishing between the input signals coming into the central monitoring station from remote control stations.

Thus, it is a principal object of this invention to provide a miniature remote alarm control circuit system with remotely placed control stations or boxes capable of producing two distinct and different alarm indications which are easily identifiable at a central monitoring station.

Another object of the present invention is to provide a miniature remote alarm monitoring and circuit control system that employs low current, approximately 200 microamps, to keep the two inputs in the normal condition and to thus provide an extremely long resistive input line capability.

It is another object of this invention to provide a remote alarm monitoring and control circuit control system that employs conventional telephone lines between remotely placed control stations and a central monitoring station over which input signals from the control stations to the monitoring station can be fed back to the specific control stations.

It is still a further object of this invention to provide a monitoring system that may be used for fire and burglar alarm type systems while at the same time providing a miniature system capable of being used to monitor equipment, the operation of irrigation systems, the status of oil wells or sewage or waste water treatment plant control and monitoring systems.

Figure 2:
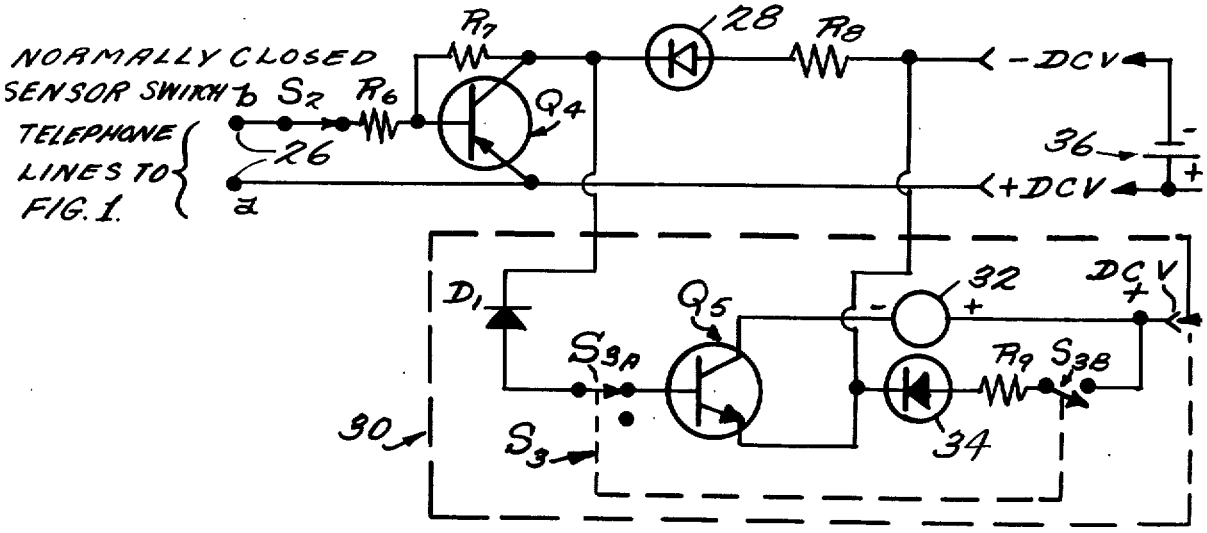

The invention will now be described by way of example only, with particular reference to the accompanying drawings in which:

FIG. 1 is a diagram of a circuit illustrating the principles of the present invention with regard to control stations; and FIG. 2 is a diagram for a circuit illustrating the principles of the invention with regard to monitoring stations.

Referring to FIG. 1, there is shown a schematic circuit diagram of the two-function control station.

The two inputs of the circuit indicated at 10 and 12, respectively, may have any voltage from approximately 3 volts DC to 12 volts DC with the polarity connected as shown. For purposes of discussing the present invention, applicant presumes that a 12 volt DC input voltage is applied to both inputs 10 and 12.

Resistors R1 and R5, respectively, isolate the DC input voltage sources from the base of transistors Q1 and Q3, respectively, but allow sufficient current to keep the transistors Q1 and Q3 turned off, or in a non-conducting mode.

Located between the negative DC voltage and resistor R1 is feed-back resistor R2 which controls the conductivity of transistor Q1.

Located within the emitted collector current path is switch S1 which can be capable of being used to reset the control station at the remote station and the coil for relay K1. The contacts for relay K1 are shown in their normal position.

The contacts of relay K1 are connected to provide the necessary bias through resistor R3 to the base of transistor Q2 so as to turn transistor Q2 "ON" when the reverse bias from telephone lines 22 is lost in the alarm mode.

More specifically, in the non-alarm mode, resistor R3 isolates the base of transistor Q2 but allows sufficient reverse bias to be applied from the +DCV source 24 through the normally closed contacts of relay K3.

In an alarm mode, the normally closed contacts of relay K1 are opened when transistor Q1 is turned ON thereby removing the reverse bias from the base of transistor Q2. Further, a negative potential from the telephone lines is simultaneously applied thereby causing transistor Q2 to turn ON.

Connected to the emitter of transistor Q2 is the control coil for a latching relay K2 having normally open and closed contacts which are shown in their normal mode and a light-emitting diode 14. The normally closed contacts of relay K2 remain unconnected while the normally open contacts serve to latch relay K1 in an energized condition after relay K2 has been energized.

The second control station input 12 has resistor R5 which, as indicated above with respect to resistor R2, serves to isolate the second DC input 12 from the base of transistor Q3 and allows sufficient current flow to keep transistor Q3 turned off or in a non-conducting mode.

Resistor R4 is a feed-back resistor and serves to control the conductivity of transistor Q3 when the voltage is lost at input 12.

Connected to the collector of transistor Q3 is the control coil for relay K3 having normally open and closed contacts which are also shown in their normal mode. Connected in parallel with the coil K3 is a capacitor C1 which form a resistor-capacitor timing circuit whose function will be described hereinafter.

Connected across the emitter of transistor Q3 and relay K3 is a photoelectric osicllator generally indicated at 16.

The photoelectric oscillator 16 comprises a photocell 18 connected across the emitter and base of transistor Q3 and a light-emitting diode 20 connected to the normally open contact of relay K3 and ground.

The output terminals 22*a* and *b* serve both inputs 10 and 12.

In operation, the circuit shown in FIG. 1 corresponding to the control station will operates as follows.

Assuming that switch S1 is closed as shown in FIG. 1, should the voltage applied to the first input be lost due to the tripping of a sensor thereby causing the normally closed sensor switch to open, the reverse base bias to transistor Q1 would be removed and Q1 would begin to conduct due to the forward DC base bias feedback through resistor R2. The resultant emitter-conductor current flow through Q1 would energize the coil windings of relay K1 connected to the collector of Q1 thereby causing the K1 relay contacts to be switched from their normal mode as shown, into an alarm mode. When this occurs, the 12-volt DC voltage reverse bias from the telephone line is no longer present on the base of Q2 and thus transistor Q2 will begin to conduct causing relay K2 to be energized due to the resultant emitter-collector current flow through the K2 control coil. The switching of the K1 relay contacts removes the phone line voltage supplied to the monitoring station and at the same time the light-emitting diode 14 becomes energized indicating that an alarm condition exists. When relay K2 is energized, the K2 contacts are switched from their normal mode, as shown, into an alarm mode and serve to latch relay K1 in the alarm mode even though the input voltage may be restored to input 10.

Turning now to the second circuit and input 12, if the input voltage supplied to input 12 is lost, the base of transistor Q3 is no longer reverse biased and transistor Q3 would now begin to conduct due to the forward DC feedback base bias current through resistor R4. The emitter-collector current path would thus energize relay K3 through the coil windings thereof and the relay contacts of relay K3 would be switched from their normal position to their alarm position. With the contacts of relay K3 in this condition, the light-emitting diode 20 now has a DC voltage applied across it and will thus be energized. With the current path likewise across the photocell 18, the illumination of the light-emitting diode 20 will cause the resistance of the photocell 18 to go from a very high resistance to a very low resistance thus causing the bias supplied through resistor R4 to be lost so that transistor Q3 will be turned off or placed in a non-conducting mode. When this occurs, the relay K3 will likewise be de-energized thereby returning the K3 contacts to their normal position so that the light-emitting diode 20 will no longer be illuminated due to the loss of the DC voltage across it. Since the light-emitting diode 20 is no longer illuminated, the resistance of the photocell 18 will again be allowed to go to a very high condition thus allowing the bias voltage produced by resistor R4 to again be present on the base transistor Q3. At this point, the entire sequence of transistor Q3 conducting and energizing relay K3 so as to illuminate the light-emitting diode 20 and cause a change in the resistance of the photocell 18 will again occur. Thus, the circuitry associated with transistor Q3 and the second input 12 of the control station serves to form an oscillator circuit whose repetition rate or whose oscillation rate is governed by the RC time constant of the coil winding K3 and the value of capacitor C1. Therefore, the repetition rate of this portion of the circuit can be easily adjusted by changing the value of capacitor C1.

When the oscillator is operating and the contacts of relay K3 are switching from their normal to their alarm condition, the telephone line voltage via contacts 22*a* and 22*b* to the monitoring station is lost every time relay K3 switches to its alarm mode. Loss of the phone line voltage will cause the alarm indicator circuitry associated with transistor Q2, described above, to conduct causing the light-emitting diode 14 to indicate that an alarm condition exists. Thus, as the oscillator circuit 16 operates to vary the conductivity of transistor Q3 and its associated circuitry, the light-emitting diode 14 will be caused to blink. Likewise, the telephone line voltage will rise and fall according to the operation of relay K3. Until the voltage normally supplied to input 12 is restored, this oscillating condition will continue.

Thus, a control station is provided that is capable of producing two distinct electrical signals of different alarm situations which are easily identifiable electrically. One is a constant or steady state alarm indication as is associated with input 10, while the other is a pulsating or blinking type of alarm associated with input 12. This pulsating or blinking type output from a control station will be from phone line outputs indicated at 22*a* and 22*b*.

Reference is now made to FIG. 2 which shows a schematic diagram of the circuit associated with the monitoring station of the present invention.

With the normal phone line voltages applied to the inputs 26*a* and 26*b* of the monitoring circuit which are connected to outputs 22*a* and 22*b*, respectively, of a remotely placed control station, there will be no audible or visual alarm indication.

Switch S2 is the monitoring station reset switch which can be employed by the person monitoring the remotely placed control stations to reset or unlatch relay K2. Thus, where the voltage is restored to input 12 of the FIG. 1 circuit, transistor Q2 and relay K2 still maintain the latched condition of the Q1 circuit in an alarm mode. By momentarily opening switch S2, a momentary opening is caused between the plus side of the telephone line and R6. The resistive loop serving as the bias for transmitter Q2 is thereby opened which de-energizes the control coils for relays K1 and K2 and light-emitting diode 14. The circuit is thus returned to a normal mode and is reset. When input voltage is thereafter lost from input 10 of the FIG. 1 control circuit, transistor Q1 is ready to again be latched in a conducting mode.

As was the case with inputs 10 and 12 in FIG. 1, resistor R6 serves to isolate the base of transistor Q4 when switch S2 is in its normally closed condition and thus maintain transistor Q4 in a turned off or non-conducting condition. Feedback transistor R7 controls the conductivity of transistor Q4 in the event that the phone line voltage to input 26 is lost.

Connected to the collector of transistor Q4 is a light-emitting diode 28 having a resistor R8 connected in series therewith. Resistor R8 is a limiting resistor and is selected so as to provide the proper voltage drop across the light-emitting diode 28. Connected in parallel with the light-emitting diode 28 and resistor R8 is the monitoring station indicator circuit generally indicated at 30.

The indicator circuit 30 comprises a transistor Q5 whose base is isolated by diode D1 while the light-emitting diode 28 is not illuminating but which allows a bias voltage to be applied to Q5 when the light-emitting diode 28 is energized indicating an alarm condition, thereby changing Q5 to a conductive mode.

Connected to the collector of transistor Q5 is an audible identification alarm 32 such as a Mallory Sonalert, but it is to be understood that any sort of audible alarm device could be employed herein. This is in turn connected with a positive DC voltage supply.

Connected to the emitter of transistor Q5 and controlled by manual switch S3, contacts S3a and S3b, is a light-emitting diode 34 having a resistor R9 in series therewith which again is selected so as to provide a proper voltage drop across the light-emitting diode 34. The switch S3 is designed to turn off the audible identification device 32 and at the same time energize the light-emitting diode 34 indicating that an audible alarm signal had been received and that that audible alarm signal has been turned off. It is to be understood that switches S3*a* and S3*b* operate together. Also, as shown in FIG. 2 a positive and negative DC voltage source 36 is also in the emitter collector circuit flow path for transistor Q4.

In describing the operation of the monitoring station as shown in FIG. 2, when the voltage on the phone line input 26 is lost, the bias to the base of transistor Q4 is lost so that transistor Q4 begins to conduct due to the DC feedback through resistor R7. This causes a current to flow through the light-emitting diode 28 thereby illuminating the light-emitting diode 28 so as to visually indicate, at the monitoring station, that an alarm condition exists at a specific control station. The sum of the voltage drops across the light-emitting diode 28 and resistor R8 are felt on the base of transistor Q5 causing Q5 to be turned on. In this condition, the current-emitter flow path of Q5 allows current to flow through the audible alarm device 32 which gives an audible indication of the previously indicated alarm condition. Once the alarm is noted, the audible alarm can be silenced by operating manual switch S3 thus removing the bias from Q5 causing it to stop conducting thereby silencing the audible alarm device 32, since, as indicated above, switches S3*a* and S3*b* operate together. Thus, when the bias is removed from the base of transistor Q5 by switch S3*a*, switch S3*b* operates to complete the circuit through light-emitting diode 34 which indicates that the audible alarm has been silenced.

The light-emitting diode 28 will remain illuminated until the voltage returns to the telephone line input at 26. When that voltage does return, the light-emitting diode 28 will no longer be illuminated and at this time, switch S3 will be manually returned to the normal position as shown in FIG. 2 so that the monitoring board would again be ready to present both audible and visual indication should a second or another alarm condition exist.

Thus, in operation the entire system will operate as follows assuming that initially the voltages are applied as shown in FIGS. 1 and 2 and all the switches are in their normal position as shown in FIGS. 1 and 2.

If the voltage to input 10 is lost, the light-emitting diode 14 of the control box would be illuminated as would the light-emitting diode 28 of the monitoring board and at the same time the sonalert device 32 would audibly indicate that an alarm condition existed. Switch S3 would then be operated so as to open switch Sc*a* and simultaneously close switch S3*b* so as to silence the Sonalert and at the same time cause current to flow and illuminate the light-emitting diode 34. After the reason for the loss of voltage to input 10 was found and the potential danger situation corrected, the system is now ready to be reset. Assuming that the voltage to input 10 is restored transistor Q2 and relay K2 of the control station remain in a latched condition. By operating switch S2 at the monitoring board, an opening of the circuit between the plus side of the phone line and resistor R6 thus serving to open the resistor loop serving as a bias source to transistor Q2. Immediately upon opening that resistive loop, relays K1 and K2 will be de-energized allowing the contacts of those relays to return to their normal position and thus turn off the light-emitting diode 14. This restoration of the contacts K1 and K2 restores the telephone line voltage to bias transistor Q2 which is now turned off. Likewise, the restoration of the line voltage turns off transistor Q4 in the monitoring board which causes the light-emitting diode 28 to be turned off. Since the light-emitting diode 28 is no longer illuminating, and indicating that there is an alarm condition existing, switch S3 can be switched back to its normal position as shown in FIG. 2 and since there is no longer a voltage drop across light-emitting diode 28 and resistor R8, transistor Q5 will likewise be turned off so that the sonalert will remain silent when switch S3 is returned to its normal position. In addition, the light-emitting diode 34 will likewise be turned off with the returning of switch S3 to its normal position.

Turning now to the second input 12 of the control station, if the voltage applied thereto is lost, transistor Q3 becomes turned on and as indicated above, the circuitry associated therewith causes relay K3 to pulsate. This will cause the voltage on the telephone line to pulsate in a like manner which will cause transistor Q2 within the control station to effectively blink on and off indicating that there is an alarm from input 12. The pulsating voltage on the phone line will be conveyed thereby to the centrally located monitoring board and will cause transistor Q4 of the monitoring board to turn on and off which will cause a blinking of the light-emitting diode 28 in a like manner. The momentary voltage drops across light-emitting diode 28 and resistor R8 will cause transistor Q5 to likewise be turned on and off in a blinking fashion so that the sonalert device 32 will be caused to emit a beep every time Q5 is turned on. When the voltage is restored to input 12 in the control station, the circuits in the control station and monitoring board will automatically be reset since relay K3 is not a latching relay.

Thus, applicant has herein described a system which effectively sends two different signals via one commercial phone line to a monitoring board. Applicant has found that the phone lines can be approximately 40,000 ohms long in terms of their resistivity. Such high resistivity allows the use of extremely long distances between the location of the monitoring board and the remote control boxes such that the distance between the two has not been found to be a critical factor.

As indicated generally at 36, relay K1 associated with the first input 10 of the control station can be provided with optional contacts which could be utilized to control remote equipment at the location where the control station is located or could be used in another portion of the security system for turning on valves or sirens. It is to be understood that additional contacts likewise could be used with relay K3 so that at the location of the control station the two different types signals could be easily distinguished, one being a constant signal, the other being in the form of intermittent flashes or sounds.

Thus, this invention has described a simple but efficient and highly operational circuitry for sensing different events at a remote location and allowing the monitoring of the remotely sensed conditions in a way that allows the operator to easily distinguish between the conditions being sensed.

Further, it will be appreciated that the invention described hereinabove is susceptible to considerable modifications and it is not to be deemed limited to the particular constructional or circuit details described herein by way of example only.

What is claimed is:

1. An alarm monitoring and control system adapted to be connected to a source of power comprising: one or more control stations each having first and second sensing means for sensing the occurrence of at least first and second events, respectively, first circuit means connected to said first sensing means for producing a first output signal, second circuit means connected to said second sensing means for producing a second output signal electrically distinguishable from said first output signal, third circuit means connected to each of said first and second circuit means for indicating the sensing of said first or second event and a monitoring station located remotely from said one or more control stations, said monitoring station including monitoring circuit means for receiving said first and second output signals and indicating said first or second event and resetting means for resetting at least one of said first and second circuit means following the termination of the event.

2. An alarm monitoring and control system connected to a suitable source of power comprising:

first circuit means for producing a first output signal in response to the sensing of a first condition, second circuit means for producing a second output signal in response to the sensing of a second condition, said second output signal being electrically distinguishable from said first output signal, third circuit means connected to each of said first and second circuit means for indicating the production of said first and second output signals, monitoring circuit means located remotely from and connected to each of said first and second circuit means for receiving said first and second output signals and for indicating the receipt thereof, wherein said first circuit means is held in an output producing mode by said third circuit means and wherein said monitoring circuit means further includes resetting means for releasing said first circuit means from its held output producing mode.

3. An alarm monitoring and control system as claimed in claim 2 wherein said first, second and third circuit means each include relay means and transistor means connected to said relay means for controlling energization of said relay means and wherein said relay means is included within said first and second circuit means to cause a steady loss of input voltage when energized, and wherein said relay means associated with said third circuit means latches said first circuit means in said output producing mode.

4. An alarm monitoring and control system as claimed in claim 3 wherein said third circuit relay means comprises means for controllably latching it in a predetermined state.

5. An alarm monitoring and control system as claimed in claim 4 wherein said third circuit means further includes a light-emitting diode connected in circuit with said latching relay.

6. An alarm monitoring and control system as claimed in claim 3 wherein said third circuit means further includes a self-latching relay having a coil in series with a light-emitting diode, said coil and said light-emitting diode being within the collector-emitter current path of the third circuit transistor means.

7. An alarm monitoring and control system as claimed in claim 6 wherein the third circuit transistor means is placed in a conductive mode by the energization of said relay means in either said first or said second circuit.

8. An alarm monitoring and control system as claimed in claim 7 wherein said second circuit means further includes oscillation means for causing the conductivity of said third circuit transistor means to pulsate thereby causing the production of said second output signal to pulsate in a like manner.

9. An alarm monitoring and control system connected to a suitable source of power comprising:

first circuit means for producing a first output signal in response to the sensing of a first condition, second circuit means for producing a second output signal in response to the sensing of a second condition, said second output signal being electrically distinguishable from said first output signal, third circuit means connected to each of said first and second circuit means for indicating the production of said first and second output signals, monitoring circuit means located remotely from and connected to each of said first and second circuit means for receiving said first and second output signals and for indicating the receipt thereof, wherein said first circuit means is held in an output producing mode by said third circuit means and wherein said monitoring circuit means further includes resetting means for releasing said first circuit means from its 1*d* output producing mode, said first, second and third circuit means each including relay means and transistor means connected to said relay means for controlling energization of said relay means and wherein said relay means is included within said first and second circuit means to cause a steady loss of input voltage when energized, and wherein said relay means associated with said third circuit means latches said first circuit means in said output producing mode, said third circuit means further including a self-latching relay having a coil in series with a light-emitting diode, said coil and said light-emitting diode being within the collector-emitter current path of the third circuit transistor means, wherein the third circuit transistor means is placed in a conductive mode by the energization of said relay means in either said first or said second circuit, said second circuit means further including oscillation means for causing the conductivity of said third circuit transistor means to pulsate thereby causing the production of said second output signal to pulsate in a like manner, wherein the third circuit relay means has normally open and closed contacts and said oscillation circuit means further includes a light-emitting diode connected in series with the normally open contacts of the third circuit relay means, a variable resistive photocell connected in parallel with the emitter and base of the second circuit transistor means and a resistance-capacitive timing circuit means for controlling the oscillation rate of said oscillating circuit means.

10. An alarm monitoring and control system as claimed in claim 9, wherein said photocell is placed immediately adjacent the light-emitting diode so that the high initial resistance of said photocell is changed to a low resistance during the period said light-emitting diode is energized.

11. An alarm monitorng and control system connected to a suitable source of power comprising:

first circuit means for producing a first output signal in response to the sensing of a first condition, second circuit means for producing a second output signal in response to the sensing of a second condition, said second output signal being electrically distinguishable from said first output signal, third circuit means connected to each of said first and second circuit means for indicating the production of said first and second output signals, monitoring circuit means located remotely from and connected to each of said first and second circuit means for receiving said first and second output signals and for indicating the receipt thereof, wherein said first circuit means is held in an output producing mode by said third circuit means and wherein said monitoring circuit means further includes resetting means for releasing said first circuit means from its held output producing mode, said first, second and third circuit means each including relay means and transistor means connected to said relay means for controlling energization of said relay means and wherein said relay means is included within said first and second circuit means to cause a steady loss of input voltage when energized, and wherein said relay means associated with said third circuit means latches said first circuit means in said output producing mode, wherein said monitoring circuit means includes a first monitoring circuit transistor adapted to be connected to the output terminals of said first and second circuit means, said first monitoring circuit transistor being biased in a normally non-conducting condition while normal voltage is present on said output terminals, a first monitoring circuit light-emitting means connected to the collector-emitter current path so that said light-emitting means will be illuminated when said first monitoring circuit transistor is in a conducting mode, and wherein said monitoring circuit further includes a signal indicating circuit connected in parallel across said first monitoring circuit light-emitting means, said indicating circuit being energized when a voltage drop is created across said first monitoring circuit light-emitting means.

12. An alarm monitoring and control system as claimed in claim 11 wherein said monitoring circuit further includes a first switch means for resetting said first circuit means from a latched output producing mode to a normal non-producing mode.

13. An alarm monitoring and control system as claimed in claim 11 wherein said indicating circuit includes a second monitoring circuit transistor, a unidirectional current conducting device connected in series with the base of said second monitoring circuit transistor for producing an audible sound in response to the output of said first or said second circuit means, said audible indicating means connected to the collector-emitter circuit of said second monitoring circuit transistor.

14. An alarm monitoring and control system as claimed in claim 13 wherein said indicating circuit further includes a light-emitting means connected in parallel with said second monitoring circuit transistor and said audible indicating means and second switch means for simultaneously opening the current path through said second monitoring circuit transistor and said audible indicating means and closing the current path through the second light-emitting means.

* * * * *